United States Patent [19]

Rowland

[11] 4,433,597

[45] Feb. 28, 1984

[54] COMBINED BOTTLE CAP OPENER

[76] Inventor: David A. Rowland, P.O. Box 2823, So. San Francisco, Calif. 94080

[21] Appl. No.: 339,766

[22] Filed: Jan. 15, 1982

[51] Int. Cl.[3] ..... B67B 7/44; B67B 7/16; B67B 7/18

[52] U.S. Cl. ..... 81/3.1 R; 81/3.4; 81/3.46 R; 7/151; 7/901

[58] Field of Search ..... 81/3.34, 3.4, 3.46 R, 81/3.46 A, 3.1 R, 3.43; 7/151, 901

[56] References Cited

U.S. PATENT DOCUMENTS

| | | | |
|---|---|---|---|
| 1,954,422 | 4/1934 | McIntyre | 81/3.4 |
| 2,514,566 | 7/1950 | Capriccio | 81/3.46 R |
| 2,625,847 | 1/1953 | Frazier | 81/3.46 R |
| 3,038,178 | 6/1962 | Schumacher | 81/3.4 |
| 3,186,263 | 6/1965 | Grote | 81/3.4 |
| 3,730,025 | 5/1973 | Monnerjahn | 81/3.4 |
| 3,730,026 | 5/1973 | Matsumoto | 81/3.46 R |
| 3,812,741 | 5/1974 | Heine | 81/3.4 |
| 4,262,560 | 4/1981 | Hoffberger | 81/3.3 R |

*Primary Examiner*—Roscoe V. Parker
*Attorney, Agent, or Firm*—James R. Cypher

[57] ABSTRACT

A bottle cap opener for prying off or twisting off tapered caps including a palm size top, a base holding a tang for engaging the cap. In a modified form the top is formed of transparent plastic. A plastic or paper member for receiving an imprinted logo is attached to the top. The device in one form includes magnets embedded in the base. Still another form is formed with an opening in the base for receiving an attachment member.

10 Claims, 21 Drawing Figures

COMBINED BOTTLE CAP OPENER

BACKGROUND OF THE INVENTION

This invention relates to an article which can remove either a crimp type tapered bottle cap also known as a crown cap or a twist-off tapered bottle cap, yet is configured so that it can display a logo in an attractive manner.

Prior bottle cap removing devices have tended to be purely functional and as a result do not lend themselves as vehicles for the display of logos. The use of functional articles to carry the logos of beverage companies or corporate logos of non-beverage related companies is a relatively recent phenomenon. There is no bottle opener known to Applicant which serves this function.

Frazier, U.S. Pat. No. 2,625,847 is an example of a bottle opener which can be folded to fit within a pocket but is incapable of serving as a logo carrying device. Frazier is formed with a swingout handle which is locked in place by turning a wingnut with a threaded shank. While the swingout handle would not be objectionable for occasionally opening a capped bottle, it would be entirely unsuitable for use by a bartender or cocktail waitress opening dozens of bottles each day. Frazier can pry-off a cap but cannot twist-off a cap.

Schumacher, U.S. Pat. No. 3,038,178 teaches a bottle cap removing and recapping device which can be cradled in the palm of the hand. This is a relatively sophisticated and costly device having several parts including a spring actuated hook for spreading the skirt portion of the bottle cap. No provision is shown for carrying a logo nor is the device capable of removing twist-off caps.

Monnerjohn, U.S. Pat. No. 3,730,025 is a device for removing twist-off caps but is incapable of removing crimped on caps.

Capreccio, U.S. Pat. No. 2,514,566, teaches a bottle cap remover with a tang for insertion beneath a cap rim and a long handle for providing leverage for prying off the cap. The device is unsuitable as an attractive device for carrying a logo. Such a device would be hardly suitable for wearing about the neck by a cocktail waitress. Capreccio cannot be used on twist-off bottles.

Heine, U.S. Pat. No. 3,812,741, is a very functional and simple device for removing screw type caps but incapable of removing pry-off type caps or carrying a corporate logo.

Hoffberger, U.S. Pat. No. 4,262,560 illustrates a recent example of removing a screw type lid from a wide mouth jar. The device has no provision for removing a pry-off cap or carrying a corporate logo.

BRIEF SUMMARY OF THE INVENTION

The main purpose of the present invention is to provide a serviceable bottle opener capable of quickly and easily removing pry-off and twist-off tapered caps from bottles and providing a surface area adapted for receiving and displaying a corporate logo or other graphic message.

An object of the present invention is to provide a bottle opener as described which has no protruding hooks, tangs or other sharp members so that it may be carried in a pocket or stored with other utensils without damaging one's clothing or other utensils.

A further object is to provide an opener as described which has aesthetic qualities such that it may be worn as a medalion around the neck, serve as a paper weight or attached to a key chain.

Still another object is to provide a bottle opener which when modified by the addition of magnets can be used as a decoration on a refrigerator or as a holder for household notes.

DESCRIPTION OF THE PREFERRED EMBODIMENTS

Figure 1:
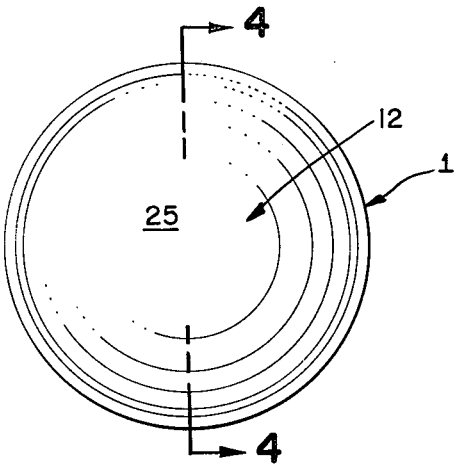
FIG. 1 is a top plan view of the present invention.

The present invention is a bottle cap removing device for removing tapered bottle caps which have a top wall and downwardly extending sidewalls tapering outwardly from a bottle which is formed with an annular outwardly extending neck ring which consists of a base member 1 dimensioned to surround a bottle cap 2 and having top and bottom walls 3 and 4. An opening 5 is formed in the base having sidewalls with at least three circumferentially spaced points on the sidewalls dimensioned to receive the top portion of the tapered cap therethrough and adapted for frictional registration with the outer sidewalls of the cap for twisting off the cap upon rotation of the base member. The configuration of the device may take various geometric shapes and as an example the sidewalls may include straight sided walls 6, 7 and 8 joined at right angles and a curved wall 9. A tang member 10 protrudes axially inwardly from the opening wall and is inset from the bottom wall 4 and is adapted for engagement with the bottom edge 11 of the bottle cap for pry-off removal. A top member 12 is connected to the top wall of the base member and covers the opening and the top wall of the base member.

EXAMPLE 1

FIGS. 1–6 illustrate one form of the invention. The top member 12 is constructed from a flexible material such as plastic permitting deformation of the top member upon engagement with a portion of the cap member and enabling pop-out removal of the cap from the bottle cap remover upon finger pressure engagement against the top member. The flexible top member permits a thin profile device.

The base member 1 may include an insert constructed from a relatively rigid material such as metal or plastic forming the sidewalls of the opening and the tang 10. A plastic annular ring 14 surrounds and is connected to the rigid insert 13.

Figure 5:
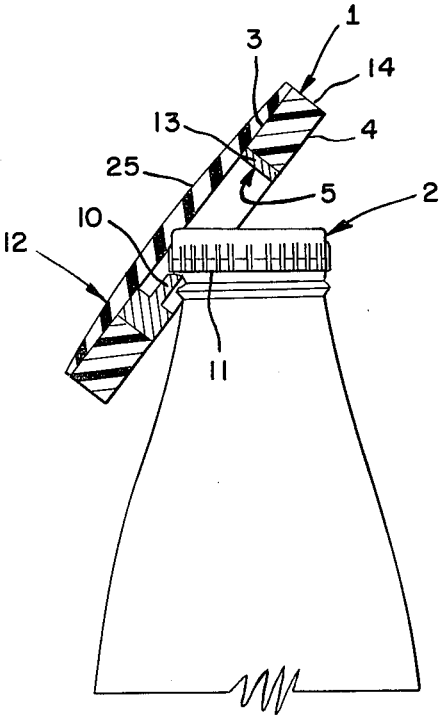
FIG. 5 is a side view of a bottle and the cross section of the device shown in FIG. 4 illustrating an application of the invention.
Figure 6:
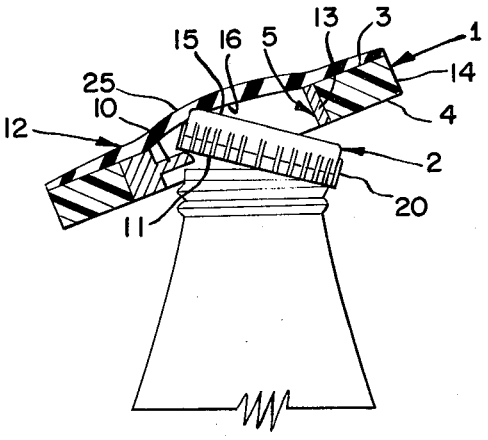
FIG. 6 is a side view similar to FIG. 5 showing the invention in another position.

Operation of the opener is illustrated in FIGS. 5 and 6. To open by prying a crimped type tapered bottle cap also known as a crown cap, the opener is tilted at an angle as shown in FIG. 5 and the tang 10 is inserted beneath the bottom edge 11 of the cap 2. The palm of the hand is placed against the top member 12 and rotated about a horizontal axis in a clockwise direction as illustrated in the drawings. As shown in FIG. 6, the straight sidewalls 7 and 8 are positioned down over the top of the cap until they frictionally engage the outwardly tapering sidewalls of the cap.

Unlike all previous cap removers in which the side walls rest upon the top of the cap which provides the fulcrum, the side walls 7 and 8 of the device frictionally engage the tapered side walls of the cap. Thus the fulcrum is provided by the tapered side walls of the cap; not the top of the cap. As the cap begins to separate from the bottle top as shown in FIG. 6, the top of the cap presses upwardly against the bottom side 16 of top member 12 and deforms the flexible material as shown. If the cap should remain lodged within the opening 5 of the opener, it may be easily removed by simply pressing downwardly on the top member and the cap will simply pop out of the opening.

Figure 8:
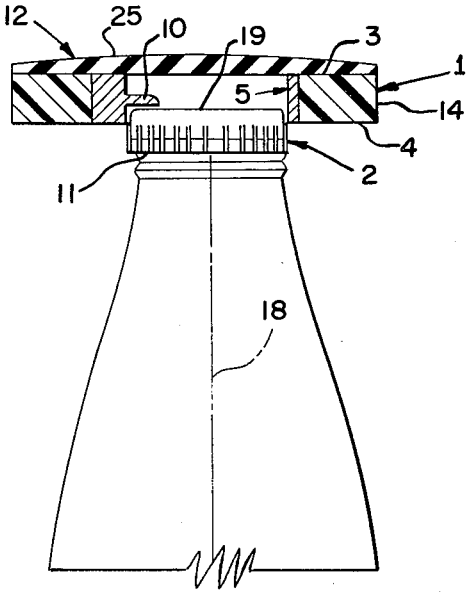
FIG. 8 is a side view of a bottle and a cross sectional view of the device as shown in FIG. 4 illustrating another use of the invention.

Operation of the bottle cap remover upon twist-off type caps is illustrated in FIG. 8. The cap remover as illustrated in FIGS. 1–6 is placed at right angles to the longitudinal axis 18 of the bottle. The cap remover is pressed downwardly upon the cap until the underside of tang 10 rests upon the top surface 19 of the cap. Sides 6, 7 and 8 are in frictional contact with the tapered sides 20 of the cap. To remove the cap it is simply necessary to press downwardly with the palm of the hand against the top member of the cap remover and rotate counterclockwise about the vertical axis 18 until the cap separates from the bottle.

EXAMPLE 2

Figure 7:
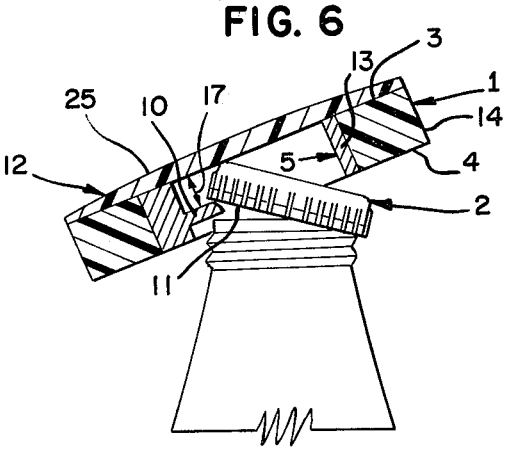
FIG. 7 is a side view of a modified form of the invention in a position similar to the position shown in FIG. 6.

A second form of the invention is illustrated in FIG. 7. In this example, the top member 12 is constructed from a non-flexible material such as metal or rigid plastic. In order for the cap to be removed it is necessary for the base member 1 to be dimensioned to provide receipt of the entire height of the cap between the top of the tang and the bottom side of the top member. Accordingly, the distance indicated by arrow 17 is increased over the space illustrated in the bottle cap remover illustrated in FIGS. 1–6.

Operation of the remover is identical to the operation described in Example 1 except that the cap must be removed from the bottom of the opener if it should lodge within the opening 5.

EXAMPLE 3

Figure 2:
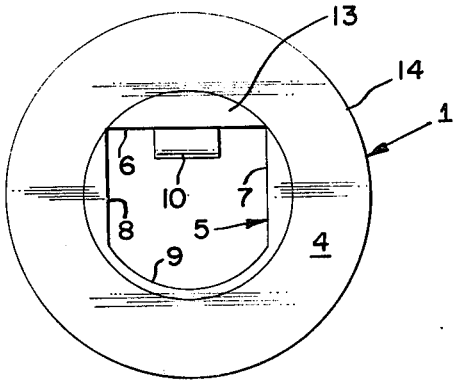
FIG.2 is a bottom plan view of the device shown in FIG. 1.
Figure 3:
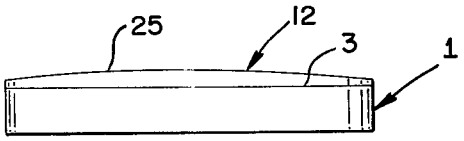
FIG. 3 is a side view of the device of FIG. 1.
Figure 4:
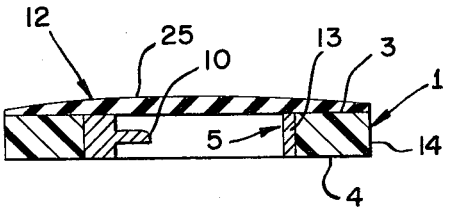
FIG. 4 is a cross sectional view taken along line 4—4 of FIG. 1.
Figure 9:
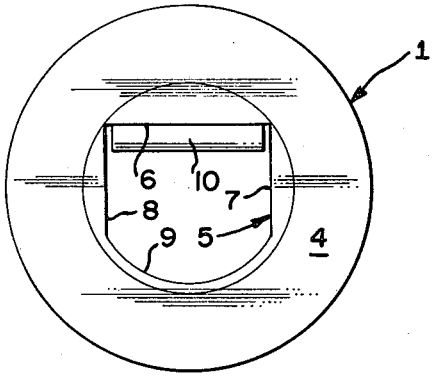
FIG. 9 is a bottom plan view of another modified form of the invention.

In Example 3 illustrated in FIG. 9, the bottle cap remover is identical to the device illustrated in FIGS. 1–6 except that the tang member 10 extends nearly the full length of wall 6 instead of only a portion of the width as shown in FIG. 2.

Operation of the bottle cap remover in both the pry-off and twist-off modes are identical to the operation of the device in Example 1.

EXAMPLE 4

Figure 10:
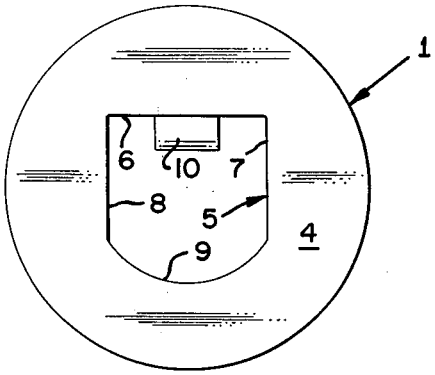
FIG. 10 is a bottom plan view of still another form of the invention.
Figure 11:
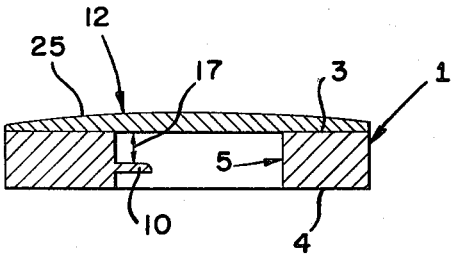
FIG. 11 is a cross sectional view of the device shown in FIG. 10.

In Example 4 illustrated in FIGS. 10 and 11, a modified form of the invention is shown. Base member 1 is constructed from the same material such as a metal. The top member 12 is constructed from a metal. The metal is relatively inflexible so that the distance from the top of the tang to the underside of the top member as shown by arrow 17 is the same as the distance 17 shown in FIG. 7. Operation of the device in the pry-off mode is the same as in Example 2 and illustrated in FIG. 7.

EXAMPLE 5

Figure 12:
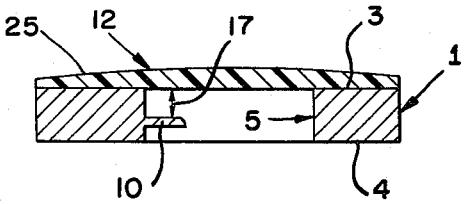
FIG. 12 is a cross sectional view of a modified form of the device shown in FIG. 10.

In Example 5 illustrated in FIG. 12, a further modified form of the cap remover is shown. The device is identical to the cap remover illustrated in FIGS. 10 and 11 except that the top member 12 is constructed from a rigid plastic. Operation of the device in both the pry-off and twist-off modes is identical to the operation of the device described in FIG. 11 and illustrated in FIGS. 10 and 11.

EXAMPLE 6

Figure 13:
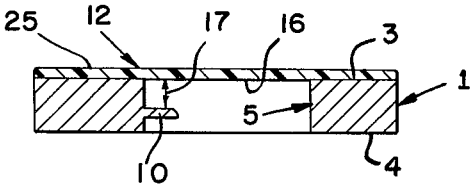
FIG. 13 is a cross sectional view of still another modified form of the device shown in FIG. 10.

In Example 6 illustrated in FIG. 13, the bottle cap remover consists of a one piece rigid base member 1 which may be either made from a rigid plastic or metal. The top member 12 is constructed with a rigid material which may be either metal or plastic. The tang member is placed a distance indicated by arrow 17 which is the same distance illustrated in FIG. 7. The main feature of the device shown in FIG. 13 is the flat top wall of the top member 12. No taper is shown in the circumference as shown in the previous examples.

Operation of the device shown in FIG. 13 is identical to the operation of the device described in Example 2 illustrated in FIG. 7 in the pry-off mode and the same as the device illustrated in FIG. 8 in the twist-off mode.

EXAMPLE 7

Figure 14:
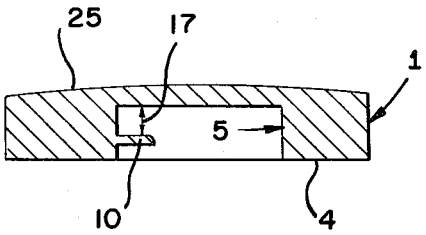
FIG. 14 is a cross sectional view of a further modified form of the device shown in FIG. 10.

In Example 7 illustrated in FIG. 14, the cap remover is constructed throughout of the same rigid plastic or metal. The tang member 10 is located from the underside 16 of the top member a distance indicated by arrow 17 a sufficient distance so that the tang can be fitted beneath the edge of the cap. Operation of the cap remover is the same as illustrated in FIG. 7. The twist-off operation is the same as illustrated in FIG. 8.

A logo or graphic message could be painted or printed on the top surface 25 of the top member of any of the forms of the invention illustrated in FIGS. 1–4.

EXAMPLE 8

Figure 15:
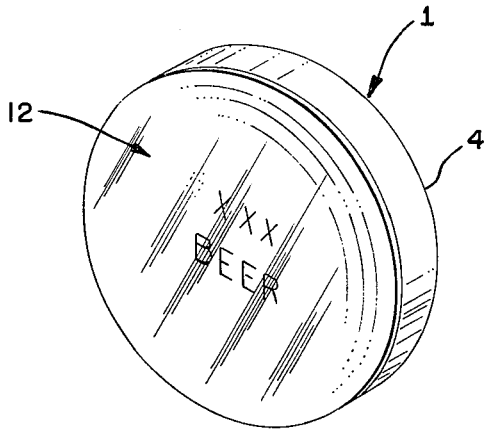
FIG. 15 is a perspective view of another form of the invention.
Figure 16:
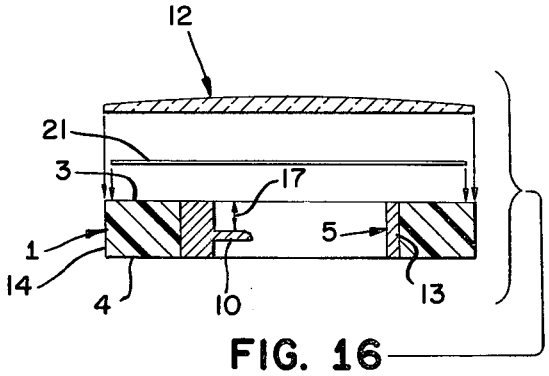
FIG. 16 is an exploded cross sectional view of the device shown in FIG. 15.

In Example 8 illustrated in FIGS. 15 and 16 the base member 1 is constructed from a metal or rigid insert member 13 and an annular plastic member 14. The tang member 10 is positioned the same distance as the tang illustrated in FIG. 11, both of which are indicated by the arrow 17. A planar insert member 21 is attached to the top wall 3 of the base member. Insert member 21 is designed to carry the logo of a corporation or other graphic message. The insert member 21 could be metal, plastic, paper or any material capable of receiving a graphic message. The top member 12 is made from a transparent material such as glass or plastic so that the logo may be seen. The top member 12 is connected to the base member 1. Operation of the device is the same as the device illustrated in FIG. 7 in the pry-off mode and the same as the device illustrated in FIG. 8 in twist-off mode.

EXAMPLE 9

Figure 17:
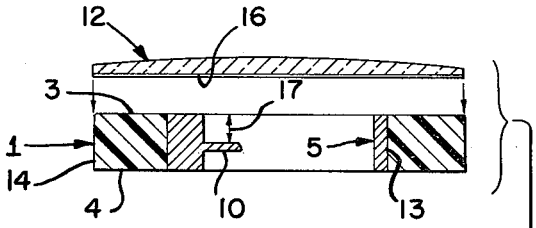
FIG. 17 is an exploded cross sectional view of a modified form of the device shown in FIG. 16.

In Example 9, illustrated in FIG. 17, the base member 1 is constructed in the same manner as illustrated in FIG. 16. In this form of the invention, a transparent top member 12 of either glass or plastic is connected directly to the top wall 3 of the base member. The bottom wall 16 of the top member receives the corporate logo or graphic message. The logo or message could be imprinted, silk screened, etched, painted or imposed by another process. Operation of the device is the same as illustrated in FIGS. 7 and 8.

It may be understood that the transparent top member 12 of FIGS. 16 and 17 and the planar insert of FIG. 16 or the manner of imposing the logo or graphic message illustrated in FIG. 17 may be used with any of the base members illustrated in FIGS. 1–13.

EXAMPLE 10

Figure 18:
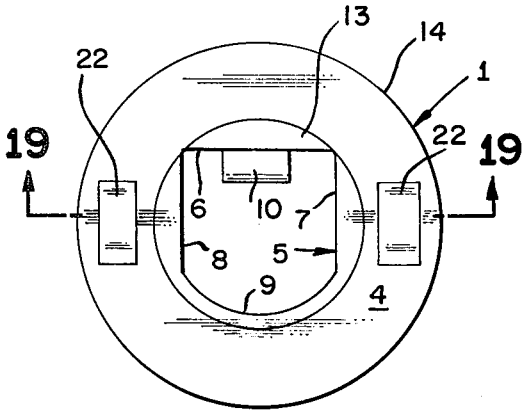
FIG. 18 is a bottom plan view of another form of the device shown in FIG. 15.
Figure 19:
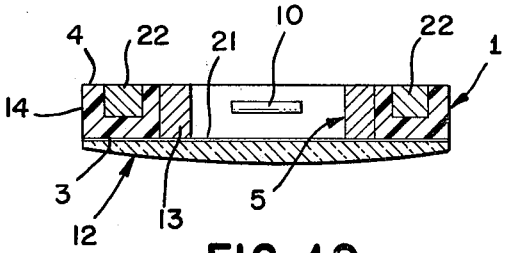
FIG. 19 is a cross sectional view of the invention shown in FIG. 18 taken along line 19—19.

In Example 10 illustrated in FIGS. 18 and 19, the device is constructed as described in Example 8 and illustrated in FIGS. 15 and 16. In addition, however, magnets 22 are embedded in the base member 1. The device may now serve as a decorative addition which may be attached to any metal surface and it may serve as an attachment device for holding messages to a metal object such as a refrigerator or bulletin board. When the planar insert 21 carries a corporate logo, it may serve as a permanent bill board of a particular company's product such as a brand of beer. As a permanent bill board on the refrigerator of a home or office, the device is useful as a gift item for a company which sells consumer food and beverage products.

EXAMPLE 11

Figure 20:
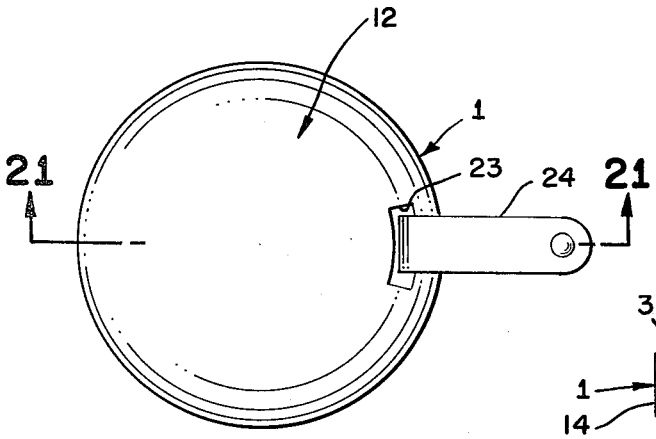
FIG. 20 is a top plan view of another form of the invention.
Figure 21:
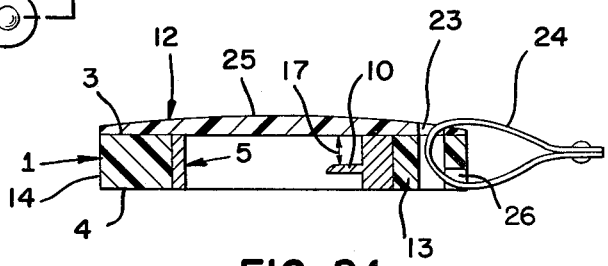
FIG. 21 is a cross sectional view of the invention shown in FIG. 20 taken along line 21—21.

In Example 11 illustrated in FIGS. 20 and 21 a further modified form of the bottle cap opener is illustrated. The opener illustrated is the same as the device shown in FIG. 7 with the exception that an opening 23 is made through the top member 12 and the annular member 14. A loop member 24 is placed through the opening 23. The loop member may be plastic, leather or other material. A chain could also be placed through the member so that the device could be worn about the neck. When the device is constructed as illustrated in FIG. 16 or 17 with a corporate logo, cocktail waitresses may wish to wear the device as a pendant which can be used to quickly open bottled beverages such as beer, sparkling waters or soft drinks.

The opening 23 may be formed with a side cut 26 in the bottom of the base member so that the loop member 24, if made of thick material, will permit the device to lie flat on a surface. The device illustrated in FIG. 21 may also be used to hold keys where a key chain is attached to the device instead of the loop 24. In this manner, a large object is provided to prevent the keys from being lost and yet a useful bottle cap remover article is also provided.

It is to be understood that the bottle cap remover may be constructed as shown in any one of the illustrations with the opening 23 being added.

I claim:

1. A palm of the hand operable bottle cap removing device for removing standard crown bottle caps which have a top wall and downwardly extending sidewalls tapering outwardly from a bottle which is formed with an annular outwardly extending neck ring comprising:

a. a rigid base member dimensioned to surround said tapered bottle cap and having top and bottom walls;

b. an opening generally formed in the center of said base having sidewalls with at least three circumferentially spaced points on said sidewall dimensioned to receive the top portion of said tapered cap therethrough and adapted for frictional registration with the outer tapered sidewalls of said cap for twisting off said cap upon rotation of said base member;

c. a tang member protruding axially inwardly from a wall of said opening and inset in from said bottom wall and adapted for engagement with the bottom edge of said bottle cap for pry-off removal of said cap; while said sidewalls of said opening in said device engage said outwardly tapering cap sidewalls which provide the fulcrum for said device; and d. a top member connected to said top wall of said base member covering said opening and said top wall of said base member providing a relatively large uninterrupted surface for use in carrying a logo or commercial message.

2. A bottle cap remover as described in claim 1 comprising:

a. said top member is constructed from a flexible material permitting deformation of said top member upon engagement with a portion of said cap member and enabling pop-out removal of said cap from said bottle cap remover upon finger pressure engagement.

3. A bottle cap remover as described in claim 1 comprising:

a. said top member is constructed from a relatively non-flexible material; and b. said base member is dimensioned to provide receipt of substantially the entire height of said cap between the top of said tang and the bottom side of said top member.

4. A bottle cap remover as described in claim 1 comprising:

a. said base member consists of a rigid insert forming the sidewalls of said opening and said tang and;

b. a plastic annular ring surrounding and connected to said rigid insert.

5. A bottle opener as described in claim 1 comprising:

a. said entire device is constructed from a single rigid material.

6. A bottle opener as described in claim 1 comprising:

a. said base member is formed from a rigid material; and b. said top member is formed from a rigid material.

7. A bottle opener as described in claim 1 comprising:

a. said top member is constructed from a transparent material; and b. a planar insert member adapted for carrying a graphic message connected between said top member and said base.

8. A bottle opener as described in claim 1 comprising:

a. said top member is constructed from a transparent material and is formed with a bottom wall adapted for receiving a graphic message imposed directly upon its surface.

9. A bottle cap opener as described in claim 4 comprising:

a. a magnet embedded in said plastic annular ring forming said base and adapted for removably attaching said bottle cap opener to a metal object for storage of said opener; and b. said base and said magnet form a planar surface.

10. A bottle cap opener as described in claim 1 comprising:

a. a topwall opening formed in said uninterrupted surface of said top member;

b. a side cut opening formed in a sidewall and joining said topwall opening; and c. a strap loop threaded through said topwall opening and said side cut opening permitting said cap opener to rest flat upon a planar surface.

* * * * *

UNITED STATES PATENT AND TRADEMARK OFFICE

CERTIFICATE OF CORRECTION

PATENT NO. : 4,433,597

DATED : February 28, 1984

INVENTOR(S) : David A. Rowland

It is certified that error appears in the above-identified patent and that said Letters Patent are hereby corrected as shown below:

In Column 4, line 68, "FIGS. 1-4" should read --- FIGS. 1-14 ---

Signed and Sealed this

*Twenty-second* Day of *May 1984*

[SEAL]

*Attest:*

GERALD J. MOSSINGHOFF

*Attesting Officer*

*Commissioner of Patents and Trademarks*